US009170058B2

(12) United States Patent
Wu

(10) Patent No.: US 9,170,058 B2
(45) Date of Patent: Oct. 27, 2015

(54) HEAT PIPE HEAT DISSIPATION STRUCTURE

(75) Inventor: Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 732 days.

(21) Appl. No.: 13/402,472

(22) Filed: Feb. 22, 2012

(65) Prior Publication Data

US 2013/0213611 A1 Aug. 22, 2013

(51) Int. Cl.

| | |
|---|---|
| ***F28D 15/00*** | (2006.01) |
| ***F28F 7/00*** | (2006.01) |
| ***F28D 15/04*** | (2006.01) |
| ***F28D 15/02*** | (2006.01) |

(52) U.S. Cl.
CPC ..... *F28D 15/046* (2013.01); *F28D 15/0233* (2013.01); *F28D 15/04* (2013.01)

(58) Field of Classification Search
CPC ..... F28D 15/04; F28D 15/043; F28D 15/046; F28D 15/0233; H01L 23/427
USPC ..... 165/104.21, 104.26, 80.2
See application file for complete search history.

(56) References Cited

U.S. PATENT DOCUMENTS

| | | | | |
|---|---|---|---|---|
| 7,520,315 | B2 * | 4/2009 | Hou et al. | 165/104.26 |
| 8,667,684 | B2 * | 3/2014 | Dai et al. | 29/890.032 |
| 8,919,427 | B2 * | 12/2014 | Wang et al. | 165/104.26 |
| 2007/0084587 | A1 * | 4/2007 | Huang et al. | 165/104.26 |
| 2007/0107875 | A1 * | 5/2007 | Lee et al. | 165/104.26 |
| 2007/0193722 | A1 * | 8/2007 | Hou et al. | 165/104.26 |
| 2007/0267178 | A1 * | 11/2007 | Hou et al. | 165/104.26 |
| 2009/0020269 | A1 * | 1/2009 | Chang et al. | 165/104.26 |
| 2010/0155031 | A1 * | 6/2010 | Wu et al. | 165/104.26 |
| 2010/0181048 | A1 * | 7/2010 | Hwang et al. | 165/104.26 |
| 2011/0000646 | A1 * | 1/2011 | Hou | 165/104.26 |
| 2011/0048683 | A1 * | 3/2011 | Chang et al. | 165/104.26 |
| 2011/0100608 | A1 * | 5/2011 | Huang et al. | 165/104.26 |
| 2011/0127013 | A1 * | 6/2011 | Kawamura et al. | 165/104.26 |
| 2011/0277964 | A1 * | 11/2011 | Dai et al. | 165/104.26 |
| 2012/0048518 | A1 * | 3/2012 | Zhou et al. | 165/104.26 |
| 2012/0111539 | A1 * | 5/2012 | Dai et al. | 165/104.26 |
| 2012/0111540 | A1 * | 5/2012 | Dai et al. | 165/104.26 |
| 2013/0037242 | A1 * | 2/2013 | Chen et al. | 165/104.26 |
| 2013/0213611 | A1 * | 8/2013 | Wu | 165/104.26 |
| 2013/0248152 | A1 * | 9/2013 | Hwang et al. | 165/104.26 |
| 2014/0054014 | A1 * | 2/2014 | Dai et al. | 165/104.26 |
| 2014/0060781 | A1 * | 3/2014 | Jia et al. | 165/104.26 |
| 2014/0102671 | A1 * | 4/2014 | Dai et al. | 165/104.26 |

* cited by examiner

*Primary Examiner* — Ljiljana Ciric
(74) *Attorney, Agent, or Firm* — C. G. Mersereau; Nikolai & Mersereau, P.A.

(57) ABSTRACT

A heat pipe heat dissipation structure includes a main body. The main body has an evaporation section, a condensation section, a chamber filled with a working fluid and at least one first capillary structure. The first capillary structure is disposed on an inner wall face of the chamber. The first capillary structure has at least one swelling capillary section. The swelling capillary section swells from a part of the first capillary structure in the evaporation section.

8 Claims, 8 Drawing Sheets

HEAT PIPE HEAT DISSIPATION STRUCTURE

BACKGROUND OF THE INVENTION

1. Field of the Invention

The present invention relates generally to a heat pipe heat dissipation structure, and more particularly to an improved heat pipe heat dissipation structure, which has better heat transfer efficiency and is able to bear greater thermal power impact.

2. Description of the Related Art

Recently, following the rapid advance of electronic techniques, various high-frequency and high-speed electronic components have been developed. Also, the integrated circuits have become more and more compact and miniaturized. Therefore, the amount of heat generated by the electronic components per unit capacity is abruptly increased. The conventional heat dissipation measures include radiating fins, heat pipes, heat conduction interfaces, etc. Nowadays, it has become a critical topic how to dissipate the heat generated by the electronic components of the more compact integrated circuit at higher heat dissipation efficiency so as to avoid high temperature and thus protect the electronic components from being damaged.

A heat pipe is a heat conduction component, which conducts heat by way of phase conversion of the working fluid contained in the heat pipe itself. The heat pipe has the characteristics of high thermal conductivity and excellent isothermality. Therefore, the heat pipe is widely applied in various fields. Moreover, the heat pipe has the advantages of high performance, compactness, flexibility and reliability and is able to solve the existent problem of heat dissipation caused by promotion of the performances of the electronic components.

The conventional heat pipe is able to transfer the heat of the electronic components to a remote end to dissipate the heat. However, this leads to another problem. That is, the capillary structure disposed on the inner wall face of the chamber of the heat pipe is limited. As a result, the amount of the working fluid absorbed by the capillary structure on the evaporation section is limited. Therefore, in case that the evaporation section of the heat pipe is used to absorb the heat generated by an electronic component with larger power, the working fluid in the capillary structure on the evaporation section often fails to process the large amount of heat in time. This will lead to dry burn and make the heat pipe lose its heat transfer function. Under such circumstance, the electronic component will burn out due to high heat. Therefore, it is tried by the applicant to provide a heat pipe heat dissipation structure in which the capillary structure has better liquid transfer ability and higher heat transfer performance.

According to the above, the conventional heat pipe has the following shortcomings:

1. The heat transfer efficiency is poor.
2. The unit area of the capillary structure of the evaporation section is limited so that the heat pipe cannot bear greater thermal power impact.
3. The amount of the transferred heat is limited.

SUMMARY OF THE INVENTION

A primary object of the present invention is to provide an improved heat pipe heat dissipation structure, which has better heat transfer efficiency A further object of the present invention is to provide the above heat pipe heat dissipation structure, which is able to bear greater thermal power impact per unit area and is able to transfer more amount of heat.

To achieve the above and other objects, the heat pipe heat dissipation structure of the present invention includes a main body. The main body has an evaporation section, a condensation section outward extending from the evaporation section, a chamber filled with a working fluid and at least one first capillary structure. The first capillary structure is disposed on an inner wall face of the chamber. The first capillary structure has at least one swelling capillary section. The swelling capillary section swells from a part of the first capillary structure in the evaporation section. Thanks to the swelling capillary section, the unit area of the first capillary structure is increased so that the heat pipe heat dissipation structure can bear greater thermal power impact to greatly increase heat transfer efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
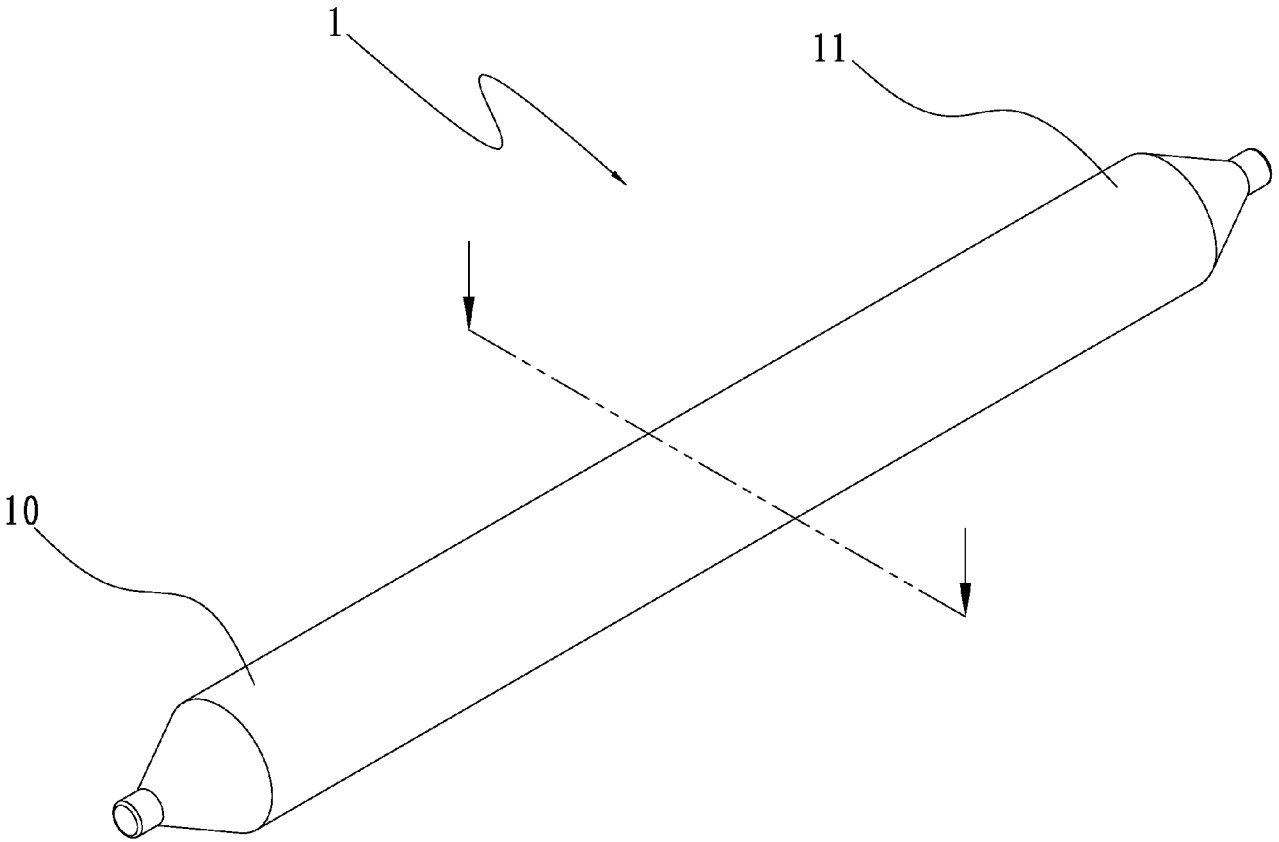
FIG. 1A is a perspective view of a first embodiment of the heat pipe heat dissipation structure of the present invention.
Figure 1B:
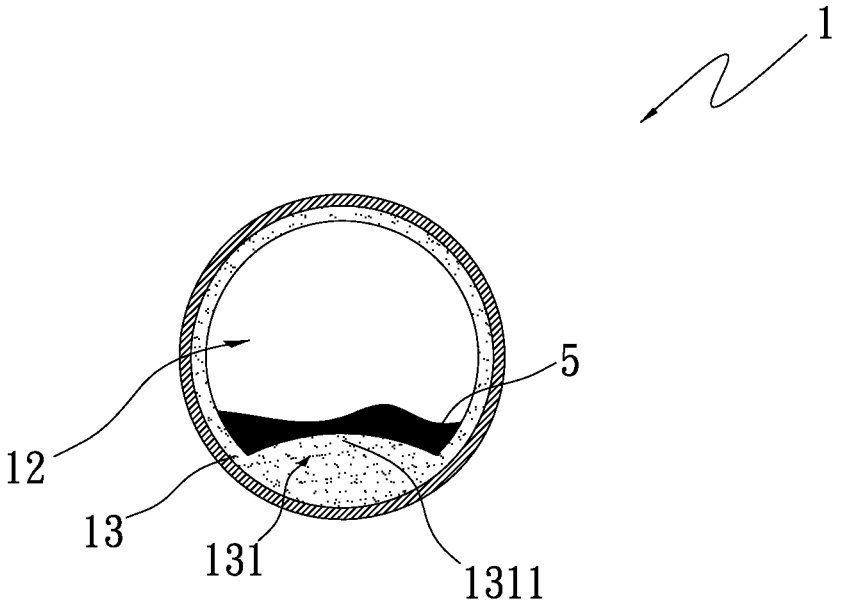
FIG. 1B is a sectional view of the first embodiment of the heat pipe heat dissipation structure of the present invention.

Please refer to FIGS. 1A and 1B. FIG. 1A is a perspective view of a first embodiment of the heat pipe heat dissipation structure of the present invention. FIG. 1B is a sectional view of the first embodiment of the heat pipe heat dissipation structure of the present invention. According to the first embodiment, the heat pipe heat dissipation structure of the present invention includes a main body 1, which is a heat pipe in the form of a circular tube. The main body 1 has an evaporation section 10, a condensation section 11 outward extending from the evaporation section 10, a chamber 12 and at least one first capillary structure 13. In this embodiment, an inner wall face of the chamber 12 is a smooth wall face for illustration purposes. A working fluid is filled in the chamber 12. The working fluid is selected from a group consisting of pure water, inorganic compound, alcohol, ketone, liquid metal, coolant and organic compound.

The first capillary structure 13 is disposed on the inner wall face of the chamber 12. The first capillary structure 13 has at least one swelling capillary section 131. The swelling capillary section 131 and the first capillary structure 13 are selected from a grouping consisting of mesh bodies, fiber bodies, sintered powder bodies, combinations of mesh bodies and sintered powder bodies and microstructure bodies. In this embodiment, the swelling capillary section 131 and the first capillary structure 13 are, but not limited to, sintered powder bodies for illustration purposes only.

The swelling capillary section 131 protrudes from the first capillary structure 13 at the evaporation section 10. In other words, the swelling capillary section 131 is integrally formed on a part of the first capillary structure 13 in the evaporation section 10.

Figure 2:
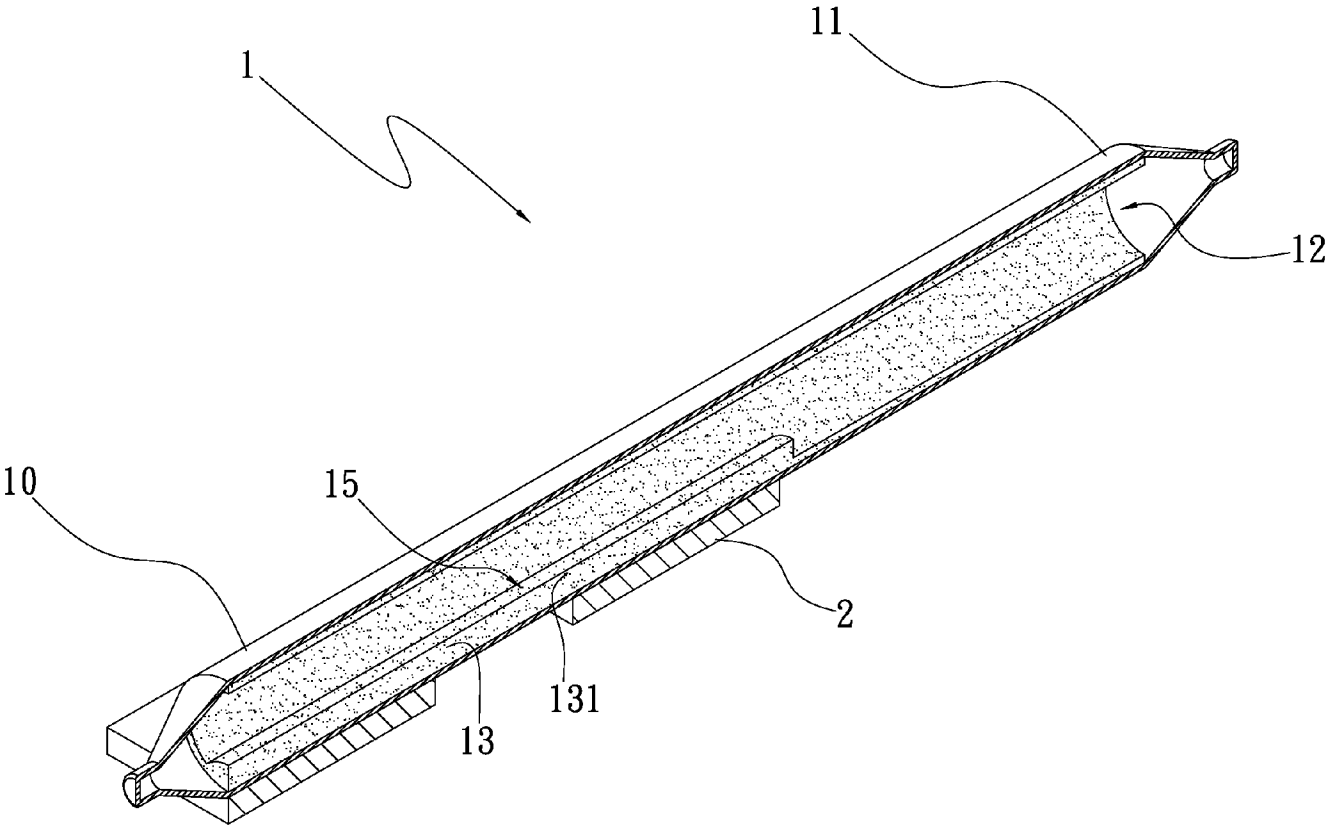
FIG. 2 is a perspective sectional view of the first embodiment of the heat pipe heat dissipation structure of the present invention.

Moreover, in practice, as shown in FIG. 2, the axial extension volume of the swelling capillary section 131 can be adjusted according to the number and size of the heat-generating components 2 (such as central processor, graphic chip, south bridge and north bridge chips or other processing chip) or according to the deployment space requirement. Moreover, the first capillary structure 13 in the condensation section 11 can be formed with the swelling capillary section 131 or free from the swelling capillary section 131 as necessary.

Further referring to FIGS. 1A and 1B, the swelling capillary section 131 has a free end 1311 radially swelling from the part of the first capillary structure 13 in the evaporation section 10 of the chamber 12. Thanks to the swelling capillary section 131 swelling from the first capillary structure 13, the outer side of the evaporation section 10 corresponding to the swelling capillary section 131 can absorb the heat generated by the heat-generating component 2 with larger power. In other words, the total unit area of the part of the first capillary structure 13 in the evaporation section 10 and the swelling capillary section 131 swelling from the part of the first capillary structure 13 is larger so that the evaporation section 10 can bear greater thermal power impact and transfer more amount of heat. Accordingly, the heat pipe is protected from being dry burnt.

Accordingly, thanks to the swelling capillary section 131 integrally formed on the first capillary structure 13 in the chamber 11 of the main body 1, the heat pipe has better heat transfer efficiency and is able to achieve excellent heat dissipation effect.

Figure 3A:
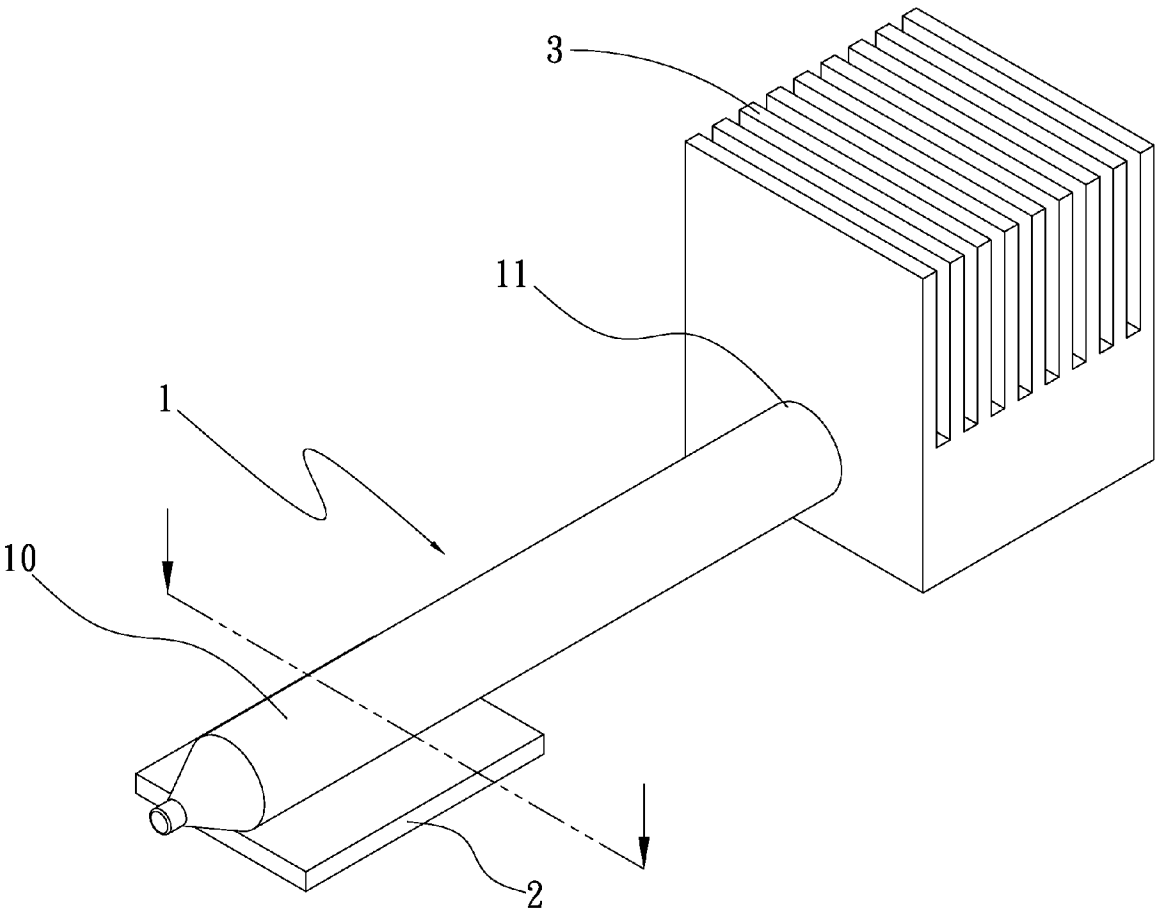
FIG. 3A is a perspective view of a second embodiment of the heat pipe heat dissipation structure of the present invention.
Figure 3B:
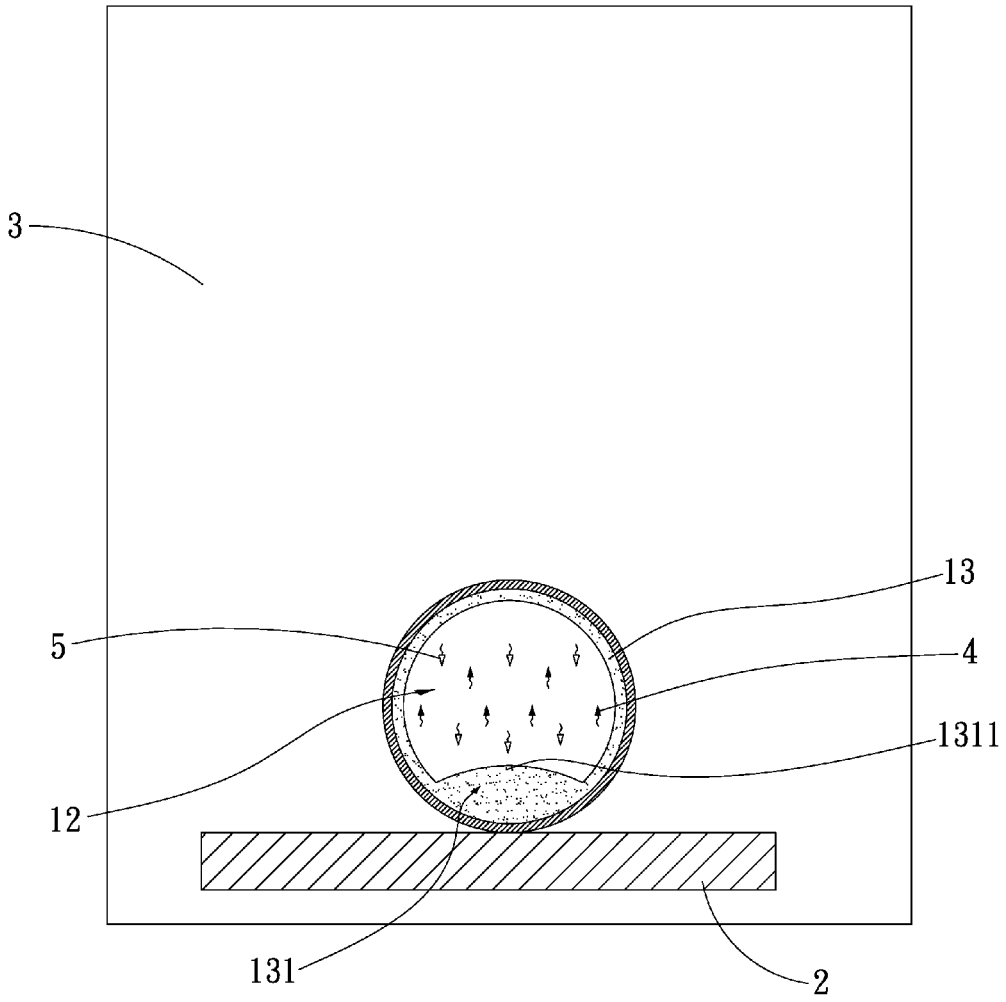
FIG. 3B is a sectional view of the second embodiment of the heat pipe heat dissipation structure of the present invention.

Please refer to FIGS. 3A and 3B. FIG. 3A is a perspective view of a second embodiment of the heat pipe heat dissipation structure of the present invention. FIG. 3B is a sectional view of the second embodiment of the heat pipe heat dissipation structure of the present invention. In the second embodiment, the main body 1 is attached to at least one heat-generating component 2 (such as central processor, graphic chip, south bridge and north bridge chips or other processing chip). That is, the outer side of the evaporation section 10 corresponding to the swelling capillary section 131 of the first capillary structure 13 in the main body 1 is attached to at least one heat-generating component 2, while a heat dissipation unit 3 is connected with the condensation section 11. The heat dissipation unit 3 is selected from a group consisting of a heat sink, a radiating fin assembly and a water-cooled unit.

Figure 4:
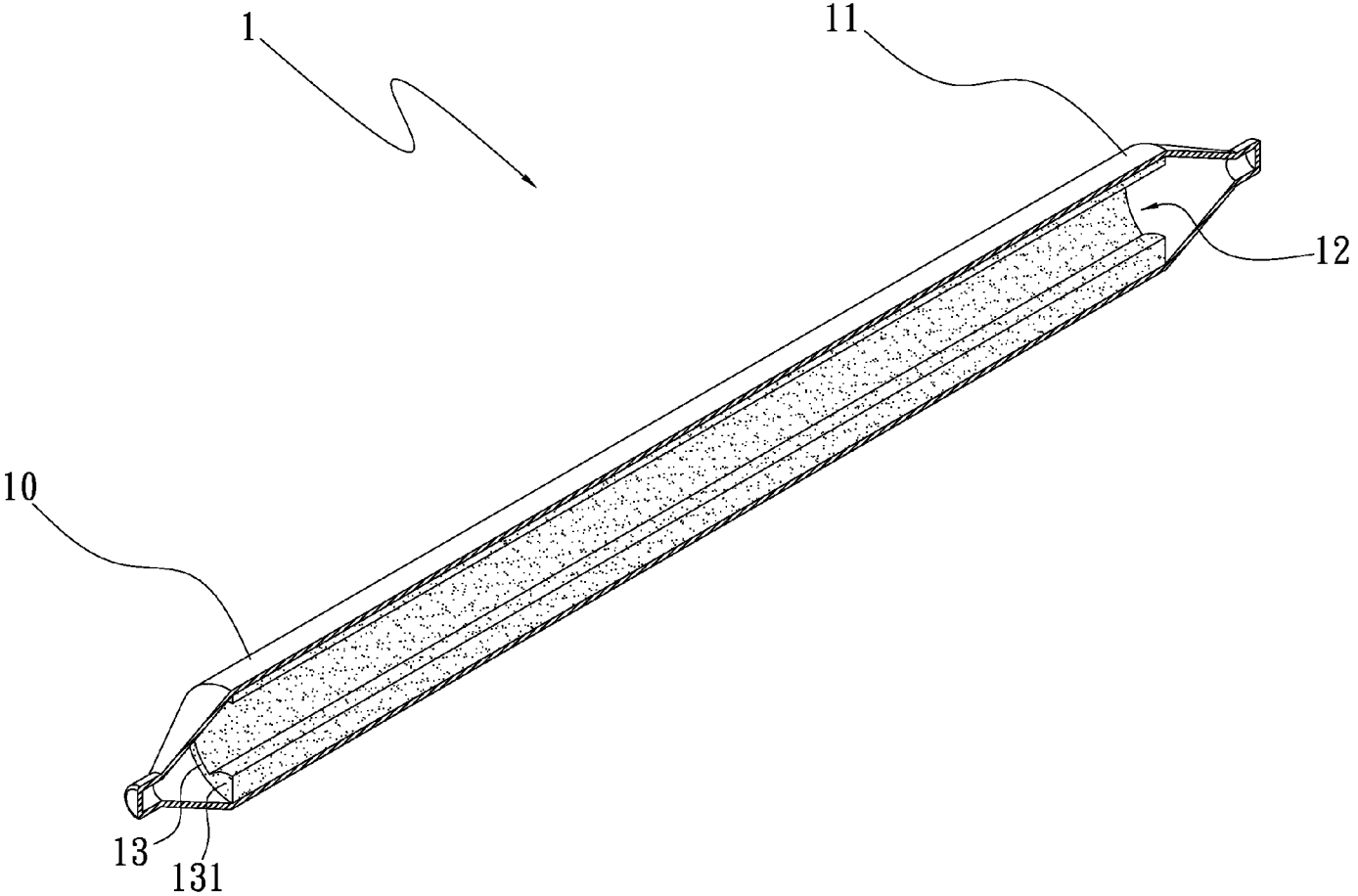
FIG. 4 is a perspective sectional view of a third embodiment of the heat pipe heat dissipation structure of the present invention.

When the heat-generating component 2 generates heat, the liquid working fluid 5 in the first capillary structure 13 and the swelling capillary section 131 rapidly absorb the heat to evaporate into vapor working fluid 4. The vapor working fluid 4 will flow toward the condensation section 11 within the chamber 12. When the vapor working fluid 4 flows to the inner wall face of the condensation section 11, (that is, the inner wall face of the chamber 12 at the condensation section 11), the heat dissipation unit 3 will absorb the heat of the vapor working fluid 4 to cool the same and dissipate the heat outward. After the vapor working fluid 4 is cooled and condensed into the liquid working fluid 5, the liquid working fluid 5 flows back to the evaporation section 10 due to gravity and capillary attraction to continue the vapor-liquid circulation. Accordingly, an excellent heat dissipation effect can be achieved. Please now refer to FIG. 4 and supplementally refer to FIG. 1A. FIG. 4 is a perspective sectional view of a third embodiment of the heat pipe heat dissipation structure of the present invention. The third embodiment is substantially identical to the first embodiment in structure, connection relationship and effect and thus will not be repeatedly described hereinafter. The third embodiment is different from the first embodiment in that the swelling capillary section 131 formed on the first capillary structure 13 axially continuously extends from the evaporation section 10 to the opposite condensation section 11. That is, the swelling capillary section 131 is integrally formed on a part of the first capillary structure 13 between the evaporation section 10 and the condensation section 11.

The free end of the swelling capillary section 131 radially swells from the part of the first capillary structure 13 between the evaporation section 10 and the condensation section 11 in the chamber 12.

Figure 5:
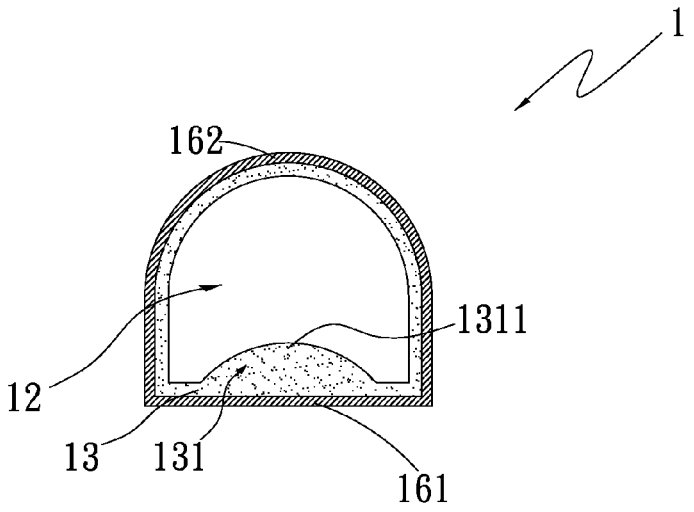
FIG. 5 is a sectional view of a fourth embodiment of the heat pipe heat dissipation structure of the present invention.

Please now refer to FIG. 5, which is a sectional view of a fourth embodiment of the heat pipe heat dissipation structure of the present invention. The fourth embodiment is substantially identical to the first embodiment in structure, connection relationship and effect and thus will not be repeatedly described hereinafter. The fourth embodiment is different from the first embodiment in that one side of the main body 1 is a plane face, while another side of the main body 1 is a non-planar face. That is, the main body 1 is formed with a plane face 161 and a non-planar face 162. The swelling capillary section 131 is formed on the first capillary structure 13 on the inner side of the plane face 161 (in the chamber 12 opposite to the non-planar face 162). The non-planar face 162 is opposite to the plane face 161. The main body 1 has, but not limited to, a substantially D-shaped cross section. Alternatively, the main body 1 can have a rectangular or semicircular cross section.

Figure 6:
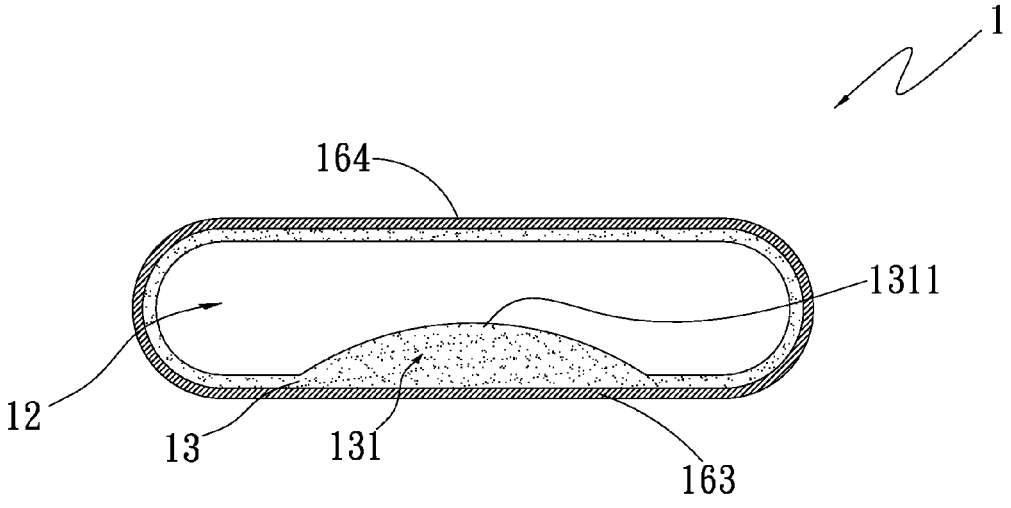
FIG. 6 is a sectional view of a fifth embodiment of the heat pipe heat dissipation structure of the present invention.

Please now refer to FIG. 6, which is a sectional view of a fifth embodiment of the heat pipe heat dissipation structure of the present invention. The fifth embodiment is substantially identical to the first embodiment in structure, connection relationship and effect and thus will not be repeatedly described hereinafter. The fifth embodiment is different from the first embodiment in that two sides of the main body 1 are both plane faces. That is, the main body 1 substantially is in a flat form and has a first plane face 163 and a second plane face 164 opposite to the first plane face 163. The swelling capillary section 131 is formed on the first capillary structure 13 on the inner side of the first plane face 163 (in the chamber 12 opposite to the second plane face 164).

Figure 7:
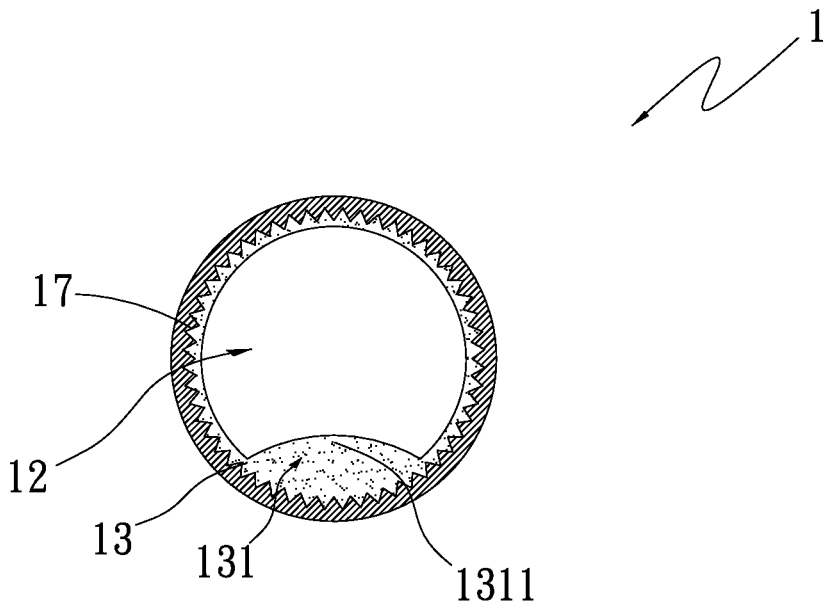
FIG. 7 is a sectional view of a sixth embodiment of the heat pipe heat dissipation structure of the present invention.

Please now refer to FIG. 7 and supplementally refer to FIG. 1A. FIG. 7 is a sectional view of a sixth embodiment of the heat pipe heat dissipation structure of the present invention. The sixth embodiment is substantially identical to the first embodiment in structure, connection relationship and effect and thus will not be repeatedly described hereinafter. The sixth embodiment is different from the first embodiment in that a second capillary structure 17 is further disposed in the chamber 12. The second capillary structure 17 is formed on the inner wall face of the chamber 12 of the main body 1. The first capillary structure 13 is disposed on the second capillary structure 17 and connected therewith.

In practice, the second capillary structure 17 is selected from a group consisting of a mesh body, a fiber body, a sintered powder body, a combination of mesh body and sintered powder body and a structure formed with multiple micro-channels. In this embodiment, the second capillary structure 17 is, but not limited to, a structure formed with multiple micro-channels for illustration purposes only. In comparison with the conventional heat pipe, the present invention has the following advantages:

1. The present invention has better heat transfer efficiency.
2. The total unit area of the first capillary structure 13 and the swelling capillary section 131 swelling from the first capillary structure 13 is larger so that the present invention can bear greater thermal power impact and transfer more amount of heat.
3. The present invention has better heat dissipation effect.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A heat pipe heat dissipation structure including a main body, the main body comprising: a chamber with a cylindrical section and an inner wall face; a working fluid disposed within the chamber; an evaporation section; a condensation section; and, a first capillary structure disposed within the chamber along the whole inner wall face and having at least one swelling capillary section, the at least one swelling capillary section extending from the first capillary structure and disposed solely within the evaporation section, wherein the at least one swelling capillary section has a free end extending radially from a part of the first capillary structure between the evaporation section and the condensation section within the chamber.

2. The heat pipe heat dissipation structure as claimed in claim 1, wherein the main body is formed with a plane face and a non-planar face opposite to the plane face.

3. The heat pipe heat dissipation structure as claimed in claim 1, wherein the main body is formed with a first plane face and a second plane face opposite to the first plane face.

4. The heat pipe heat dissipation structure as claimed in claim 1, wherein a second capillary structure is further disposed in the chamber, the second capillary structure being formed on the inner wall face of the chamber of the main body, the first capillary structure being disposed on the second capillary structure and connected therewith.

5. The heat pipe heat dissipation structure as claimed in claim 4, wherein the second capillary structure is selected from the group consisting of mesh bodies, fiber bodies, sintered powder bodies, combinations of mesh bodies and sintered powder bodies, and a structure formed with multiple micro-channels.

6. The heat pipe heat dissipation structure as claimed in claim 1, wherein the first capillary structure and the at least one swelling capillary section are selected from a grouping consisting of mesh bodies, fiber bodies, sintered powder bodies, combinations of mesh bodies and sintered powder bodies and microstructure bodies.

7. The heat pipe heat dissipation structure as claimed in claim 1, wherein the evaporation section is correspondingly attached to at least one heat-generating component, while the condensation section is correspondingly connected with a heat dissipation unit, the heat dissipation unit being selected from the group consisting of a heat sink, a radiating fin assembly and a water-cooled unit.

8. The heat pipe heat dissipation structure as claimed in claim 1, wherein the inner wall face of the chamber is a smooth wall face.

* * * * *